US010068462B2

(12) United States Patent
Buck, Jr.

(10) Patent No.: US 10,068,462 B2
(45) Date of Patent: Sep. 4, 2018

(54) SYSTEMS AND METHODS FOR MANUAL TAMPER RESET IN A MONITORING SYSTEM

(71) Applicant: BI Incorporated, Boulder, CO (US)

(72) Inventor: James J. Buck, Jr., Longmont, CO (US)

(73) Assignee: BI Incorporated, Boulder, CO (US)

( * ) Notice: Subject to any disclaimer, the term of this patent is extended or adjusted under 35 U.S.C. 154(b) by 0 days.

(21) Appl. No.: 15/280,956

(22) Filed: Sep. 29, 2016

(65) Prior Publication Data

US 2018/0089989 A1 Mar. 29, 2018

(51) Int. Cl.
*G08B 29/04* (2006.01)
*G08B 25/10* (2006.01)

(52) U.S. Cl.
CPC ..... *G08B 29/046* (2013.01); *G08B 25/10* (2013.01)

(58) Field of Classification Search
CPC .. G08B 29/046; G08B 21/02; G08B 21/0261; G08B 21/088
See application file for complete search history.

(56) References Cited

U.S. PATENT DOCUMENTS 4,005,399 A * 1/1977 Pazemenas ..... G08B 25/06 340/538
7,930,927 B2 4/2011 Cooper et al.
8,493,219 B2 7/2013 Buck et al.
8,576,065 B2 11/2013 Buck et al.
8,629,776 B2 1/2014 Buck et al.
8,657,744 B2 2/2014 Rompa et al.
9,240,118 B2 1/2016 Melton
9,241,659 B2 1/2016 Rompa et al.
9,668,095 B1 5/2017 Newell et al.
2005/0179541 A1* 8/2005 Wolfe ..... G08B 13/2462 340/539.22
2011/0154887 A1 6/2011 Cooper et al.
2013/0006066 A1 1/2013 Melton
2015/0048948 A1 2/2015 Buck et al.
2015/0061864 A1 3/2015 Buck et al.
2015/0078622 A1 3/2015 Buck et al.
2015/0131085 A1 5/2015 Cooper et al.
2015/0228184 A1 8/2015 Buck et al.
2015/0279200 A1 10/2015 Buck et al.
2015/0327214 A1 11/2015 Buck et al.
2016/0306024 A1 3/2016 Buck et al.

OTHER PUBLICATIONS

U.S. Appl. No. 14/966,135, Dec. 11, 2015, Donald A. Melton.
U.S. Appl. No. 15/207,121, Jul. 11, 2016, Buck et al.
U.S. Appl. No. 15/257,249, Sep. 6, 2016, Cooper et al.
U.S. Appl. No. 15/495,365, Apr. 24, 2017, Newell et al.

* cited by examiner

*Primary Examiner* — Curtis Odom
(74) *Attorney, Agent, or Firm* — Hamilton, DeSanctis & Cha

(57) ABSTRACT

Various embodiments of the present invention provide systems and method for resetting one or more status indicators in a monitoring system.

24 Claims, 5 Drawing Sheets

SYSTEMS AND METHODS FOR MANUAL TAMPER RESET IN A MONITORING SYSTEM

BACKGROUND OF THE INVENTION

Various embodiments of the present invention provide systems and method for resetting one or more status indicators in a monitoring system.

Large numbers of individuals are currently monitored as part of parole requirements or other requirements. Such monitoring allows a monitoring agency to determine whether the individual is engaging in acceptable patterns of behavior, and where an unacceptable behavior is identified to stop such behavior going forward. Many monitoring systems include a monitoring device attached to an individual where the monitoring device includes one or more tamper detection systems capable of determining whether the monitoring device has been compromised. In some cases where the monitoring device has been compromised, personnel must adjust the monitoring device using specialized tools to assure the device is still fully operable. Such an approach requires significant costs for both personnel and inventory of monitoring devices.

Thus, for at least the aforementioned reasons, there exists a need in the art for more advanced approaches, devices and systems for monitoring.

BRIEF SUMMARY OF THE INVENTION

The present invention is related to resetting one or more status indicators in a monitoring system.

This summary provides only a general outline of some embodiments according to the present invention. Many other objects, features, advantages and other embodiments of the present invention will become more fully apparent from the following detailed description, the appended claims and the accompanying drawings and figures.

BRIEF DESCRIPTION OF THE DRAWINGS

A further understanding of the various embodiments of the present invention may be realized by reference to the figures which are described in remaining portions of the specification. In the figures, similar reference numerals are used throughout several drawings to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION OF THE INVENTION

Figure 1A:
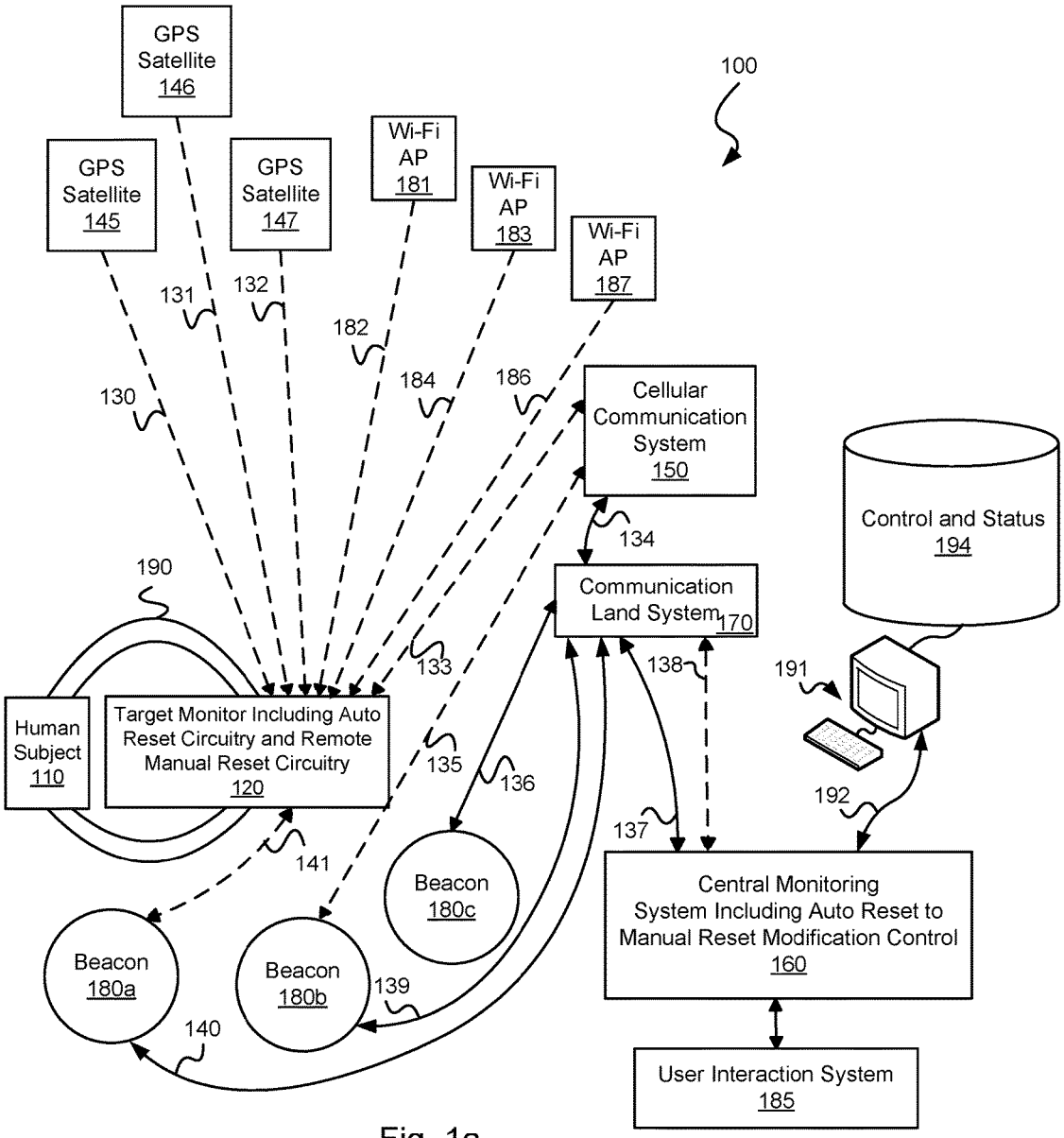
FIG. 1*a* is a block diagram illustrating a monitoring system including a target monitor device having both auto reset circuitry and remote manual reset circuitry in accordance with various embodiments of the present invention.

The present invention is related to resetting one or more status indicators in a monitoring system.

Various embodiments provide monitoring systems that include a monitoring device. The monitoring device includes a tamper detection circuit, a first tamper reset circuit, a second tamper reset circuit, and a controller circuit. The tamper detection circuit is operable to set a tamper indicator when an event indicative of a tamper with the monitoring device is detected. The first tamper reset circuit is operable to reset the tamper indicator based upon a first reset condition, and the second tamper reset circuit is operable to reset the tamper indicator based upon a second reset condition. The controller circuit is operable to select only one of the first tamper reset circuit or the second tamper reset circuit to govern a reset of the tamper indicator.

In some instances of the aforementioned embodiments, the tamper detection circuit includes at least one of: a strap continuity detector circuit, a proximity sensor circuit, and a shielding sensor circuit. In various instances of the aforementioned embodiments, the tamper detection circuit includes at least two of: a strap continuity detector circuit, a proximity sensor circuit, and a shielding sensor circuit.

In one or more instances of the aforementioned embodiments, the controller circuit is operable to select the first tamper reset circuit upon initialization of the monitoring device. In some such instances, the monitoring system further includes a central monitoring system. The monitoring device is operable to report the tamper indicator to the central monitoring system via a communication link, and the central monitoring system is operable to send a command to the monitoring device via the communication link based at least in part on the tamper indicator. The command is operable to cause the controller circuit to select the second tamper reset circuit based upon the command. In particular cases, the first tamper reset circuit is an auto tamper reset circuit that resets the tamper indicator without intervention from an authorized person; and the second tamper reset circuit is a manual tamper reset circuit that resets the tamper indicator only after intervention from the authorized person. The manual tamper reset circuit may be a remote manual tamper reset circuit that resets the tamper indicator only after the authorized person logs in remotely and approves the reset. Alternatively, or in addition, the manual tamper reset circuit is a local manual tamper reset circuit that resets the tamper indicator only after a specialized tool is used in proximity to the monitoring device. In some cases, the specialized tool generates a magnetic field detectable by the local manual tamper reset circuit.

Other embodiments provide methods for governing tamper detection in a monitoring system. The methods include: providing a monitoring device including a tamper detection circuit operable to set a tamper indicator when an event indicative of a tamper with the monitoring device is detected; initializing a reset of the tamper indicator of the monitoring device in a first tamper reset mode; transmitting the tamper indicator to a central monitoring system; and receiving a command from the central monitoring system at least in part based upon the tamper indicator. The command causes a change in the reset of the tamper indicator of the monitoring device to a second tamper reset mode.

In some instances of the aforementioned embodiments, the tamper detection circuit includes at least one of: a strap continuity detector circuit, a proximity sensor circuit, and a shielding sensor circuit. In various instances of the aforementioned embodiments, transmitting the tamper indicator to the central monitoring system is done using a wireless communication link. In some cases, the wireless communication link is a cellular communication link.

In one or more instances of the aforementioned embodiments, the first tamper reset mode is an auto tamper reset mode that resets the tamper indicator without intervention from an authorized person; and the second tamper reset mode is a manual tamper reset mode that resets the tamper indicator only after intervention from the authorized person. In some such instances, the manual tamper reset mode is a remote manual tamper reset mode that resets the tamper indicator only after the authorized person logs in remotely and approves the reset. In other such instances, the manual tamper reset mode is a local manual tamper reset mode that resets the tamper indicator only after a specialized tool is used in proximity to the monitoring device. In some cases, the specialized tool generates a magnetic field detectable by the local manual tamper reset circuit.

Yet other embodiments provide monitoring systems that include a monitoring device. The monitoring device includes: a tamper detection circuit operable to set a tamper indicator when an event indicative of a tamper with the monitoring device is detected and a processing circuit. The processing circuit is operable to initialize a reset of the tamper indicator of the monitoring device in a first tamper reset mode; transmit the tamper indicator to a central monitoring system; receive a command from a central monitoring system at least in part based upon the tamper indicator; and based at least in part on the command change the reset of the tamper indicator of the monitoring device to a second tamper reset mode.

Additional embodiments provide monitoring systems that include a monitoring device. The monitoring device includes a tamper detection circuit, a plurality of tamper reset circuits, and a controller circuit. The plurality of tamper reset circuits include at least: a first tamper reset circuit and a second tamper reset circuit. The tamper detection circuit is operable to set a tamper indicator when an event indicative of a tamper with the monitoring device is detected. The first tamper reset circuit is operable to reset the tamper indicator based upon a first reset condition, and the second tamper reset circuit is operable to reset the tamper indicator based upon a second reset condition. The controller circuit is operable to select only one of the plurality of tamper reset circuits to govern a reset of the tamper indicator.

In some instances of the aforementioned embodiments, the tamper detection circuit includes at least one of: a strap continuity detector circuit, a proximity sensor circuit, and a shielding sensor circuit. In various instances of the aforementioned embodiments, the tamper detection circuit includes at least two of: a strap continuity detector circuit, a proximity sensor circuit, and a shielding sensor circuit.

In one or more instances of the aforementioned embodiments, the controller circuit is operable to select the first tamper reset circuit upon initialization of the monitoring device. In some such instances, the monitoring system further includes a central monitoring system. The monitoring device is operable to report the tamper indicator to the central monitoring system via a communication link, and the central monitoring system is operable to send a command to the monitoring device via the communication link based at least in part on the tamper indicator. The command is operable to cause the controller circuit to select the second tamper reset circuit based upon the command. In particular cases, the first tamper reset circuit is an auto tamper reset circuit that resets the tamper indicator without intervention from an authorized person; and the second tamper reset circuit is a manual tamper reset circuit that resets the tamper indicator only after intervention from the authorized person. The manual tamper reset circuit may be a remote manual tamper reset circuit that resets the tamper indicator only after the authorized person logs in remotely and approves the reset. Alternatively, or in addition, the manual tamper reset circuit is a local manual tamper reset circuit that resets the tamper indicator only after a specialized tool is used in proximity to the monitoring device. In some cases, the specialized tool generates a magnetic field detectable by the local manual tamper reset circuit.

Other embodiments provide methods for governing tamper detection in a monitoring system. The methods include: providing a monitoring device including a tamper detection circuit operable to set a tamper indicator when an event indicative of a tamper with the monitoring device is detected; initializing a reset of the tamper indicator of the monitoring device in a first tamper reset mode; transmitting the tamper indicator to a central monitoring system; and receiving a command from the central monitoring system at least in part based upon the tamper indicator. The command causes a change in the reset of the tamper indicator of the monitoring device to a second tamper reset mode.

In some instances of the aforementioned embodiments, the tamper detection circuit includes at least one of: a strap continuity detector circuit, a proximity sensor circuit, and a shielding sensor circuit. In various instances of the aforementioned embodiments, transmitting the tamper indicator to the central monitoring system is done using a wireless communication link. In some cases, the wireless communication link is a cellular communication link.

In one or more instances of the aforementioned embodiments, the first tamper reset mode is an auto tamper reset mode that resets the tamper indicator without intervention from an authorized person; and the second tamper reset mode is a manual tamper reset mode that resets the tamper indicator only after intervention from the authorized person. In some such instances, the manual tamper reset mode is a remote manual tamper reset mode that resets the tamper indicator only after the authorized person logs in remotely and approves the reset. In other such instances, the manual tamper reset mode is a local manual tamper reset mode that resets the tamper indicator only after a specialized tool is used in proximity to the monitoring device. In some cases, the specialized tool generates a magnetic field detectable by the local manual tamper reset circuit.

Turning to FIG. 1*a*, a monitoring system 100 including a target monitor device 120 having both auto reset circuitry and remote manual reset circuitry in accordance with various embodiments of the present invention. Monitoring system 100 may be tailored for tracking human subjects, however, it should be noted that various implementations and deployments of monitoring system 100 may be tailored for tracking non-human targets such as, for example, other animals or inanimate assets or objects. Such inanimate assets or objects may include, but are not limited to, automobiles, boats, equipment, shipping containers or the like. In one particular embodiment, monitoring system 100 is tailored for tracking delivery vehicles. Based upon the disclosure provided herein, one of ordinary skill in the art will recognize a variety of individuals, animals and/or assets that may be monitored in accordance with different embodiments of the present invention, and/or different monitoring scenarios or systems that may be modified to incorporate one or more features disclosed herein. Further, it should be noted that while monitoring system 100 is discussed as using a combination of GPS, Wi-Fi, AFLT and beacon based position determination technologies, that other position determination technologies may be used as well. Such other position determination technologies include, but are not limited to, Locaid™ and Get Cell.

Monitoring system 100 includes, but is not limited to, target monitor device 120 that is physically coupled to a human subject 110 by a securing device 190. In some cases, securing device 190 is a strap that includes a tamper sensor that may be, but is not limited to, a continuity sensor that when broken indicates an error or tamper condition. Further, in some cases, the tamper sensor may alternatively or additionally be implemented as a proximity sensor that is able to detect when it has been moved away from an individual being monitored. When such movement away from the individual is detected, an error or tamper condition may be indicated. Based on the disclosure provided herein, one of ordinary skill in the art will recognize a variety of tamper sensors that may be incorporated in either target monitor device 120, securing device 190, or a combination of both target monitor device 120 and securing device 190 to allow for detection of removal of target monitor device 120 or other improper or unexpected meddling with target monitor device 120. Further, based upon the disclosure provided herein, one of ordinary skill in the art will recognize a variety of monitors and/or securing devices that may be appropriate where the target of the monitoring is not a human or other animal subject, but rather an asset.

Target monitor device 120 is designed to provide the location of human subject 110 under a number of conditions. For example, when target monitor device 120 is capable of receiving wireless GPS location information 130, 131, 132 from a sufficient number of GPS satellites 145, 146, 147 respectively, target monitor device 120 may use the received wireless GPS location information to calculate or otherwise determine the location of human subject 110. Alternatively or in addition, the location of a beacon 180 that is local to target monitor device 120 may be used as the location of target monitor 120. As yet another alternative, an AFLT (i.e., advanced forward link trilateration) fix may be established based on cellular communication with target monitor device 120. It should be noted that other types of earth based triangulation may be used in accordance with different embodiments of the present invention. As yet another alternative, when target monitor device 120 is capable of receiving Wi-Fi signals 182, 184, 186 from one or more Wi-Fi access points 181, 183, 187 respectively, target monitor device 120 may use the received Wi-Fi access point identification information along with signal strength information to resolve location. Based on the disclosure provided herein, one of ordinary skill in the art will recognize other types of earth based triangulation that may be used.

As yet another alternative, an AFLT fix may be established based on cellular communications between target monitor device 120 and a cellular communication system 150. Furthermore, when wireless communication link 133 between target monitor device 120 and cellular communications system 150 is periodically established, at those times, target monitor device 120 may report status and other stored records including location fixes to a central monitoring system 160 via wireless communication link 138.

Monitoring system 100 may include at least one beacon 180. Within FIG. 1*a*, a telemetric wireless link 141 has been depicted between beacon 180*a* and target monitor 120. Each beacon 180 has an adjustable range to make telemetric wireless contact with target monitor 120. At any point in time, depending on each beacon's 180 relative distance to target monitor 120, none, one, or more than one tracking beacons 180 may be within transmission range of a single target monitor 120. Likewise, it is further conceivable under various circumstances that more than one target monitor device 120 at times be within in range of a solitary beacon 180. In some cases, a Wi-Fi receiver within target monitor device 120 may have a broadcasting mode that could be used to broadcast to another Wi-Fi module acting as a Beacon. This would alleviate the need for proprietary radio frequency components and antennas from a design.

Telemetric wireless communications path 141 established at times between tracking beacon 180*a* and target monitor device 120 illustrates a common feature of various different embodiments of the current invention. Some embodiments of the various inventions vary on how, i.e. protocol, and what information and/or signaling is passed over wireless link 141. For example, in more simplified configurations and embodiments, each beacon 180 is limited to repetitively transmitting its own beacon ID and physical location information. In that way, once target monitor device 120 is within transmission range of tracking beacon 180*a* and establishes wireless or wired reception 141, then target monitor device 120 can record and store received beacon ID and location information. At a later time, for some embodiments of the present invention, target monitor device 120 can then report recorded readings from beacons 180 to the central monitoring system 160 over the cellular communication system 150 using wireless links 133 and 138 as depicted in FIG. 1*a*. Furthermore, many embodiments allow for such transmissions and information passing to occur without being noticed by human subject 110, and unnoticed, automatically, and near effortlessly central monitoring system 160 is able to establish records and track human subject's 110 movements and whereabouts.

In other embodiments or configurations according to the present invention, each beacon 180 also transmit status information related to its own device health and information related from each beacon's 180 internal tampering, movement, or other sensors via a communication system 170 to central monitoring system 160. This allows for detection of movement of beacons 180, and establishing some level of confidence that the location reported by each of beacons 180 is accurate. Various other details about a beacon based system are disclosed in U.S. patent application Ser. No. 12/041,746 entitled "Beacon Based Tracking Devices and Methods for Using Such" and filed Mar. 4, 2008 by Buck et al. The entirety of the aforementioned reference is incorporated herein by reference for all purposes.

Likewise, in some other embodiments, each target monitor device 120 contains a host of their own power status, tampering, shielding, movement, and/or other sensors related to its own device health. While still further embodiments also include a host of other measurement transducers within target monitor device 120 for extracting information, and for later reporting, related to physical properties of human subject 110. For example, measuring for the presence of alcohol and/or other drugs present in human subject 110 may be included in some embodiments of target monitor 120. As one example, the alcohol sensor discussed in U.S.

Pat. No. 7,930,927 entitled "Transdermal Portable Alcohol Monitor and Methods for Using Such" and filed by Cooper et al. on Mar. 4, 2008. The entirety of the aforementioned reference is incorporated herein by reference for all purposes.

Beacons 180 in alternative embodiments of the present invention may communicate with central monitoring system 160 independently of target monitor 120. The monitoring system 100 illustrated in FIG. 1*a* shows a beacon 180*b* having both a wireless communication link 135 with cellular communication system 150, and also illustrates beacon 180*b* having a hardwired communication link 139 with land communication system 170. Monitoring system 100 is also shown with beacons 180*a*, 180*b*, and 180*c* each having hardwired land communication links 140, 139, and 136 respectively to land communication system 170. Monitoring system 100 further illustrates land communication system 170 having a hardwired communication link 134 to cellular communication system 150, and a hardwired communication link 137 to central monitoring system 160.

In some embodiments of the present invention, beacons 180 are located in areas frequented by human subject 110 where target monitor device 120 is incapable of accessing information from the GPS system. Such beacons eliminate the need to perform an AFLT fix and avoid the costs associated therewith. As an example, human subject 110 may have a tracking beacon 180 placed within his home, and one also placed at his place of employment in close proximity to his work area. In this way, the two placed beacons, each at different prescribed times, can interact with his attached target monitor device 120 to periodically make reports to central monitoring system 160 to track movements and the whereabouts of human subject 110. All this can be done without incurring the costs associated with performing an AFLT fix.

Monitoring system 100 further includes a control station 191 that is communicably coupled to central monitoring system 160 via a communication link 192. In one particular embodiment of the present invention, control station 191 is a personal computer including a display device, a processor, and/or one or more I/O devices. Based upon the disclosure provided herein, one of ordinary skill in the art will recognize a variety of systems that may be used as control station 191 including highly tailored application specific control systems. A control and status data and instruction memory 194 is communicably coupled to control station 191 and maintains instructions executable by control station 191 along with providing storage for information derived from target monitor device 120.

Central monitoring system 160 includes functionality for modifying tamper reset protocol for target monitoring device 120. In some embodiments, target monitoring device 120 supports two or more tamper reset protocols. In various particular embodiments, target monitor device 120 supports three tamper reset protocols: a local manual reset, a remote manual reset, and an auto reset.

The aforementioned local manual reset requires an authorized person to use a specialized tool to reset any tamper indication that occurs on the target monitor device. Thus, for example, where the target monitor device detects some form of tampering with the device or the attachment to the target a tamper indication is set. To reset this tamper indication, the authorized person must visit the target and reset the tamper indication using a specialized tool. The specialized tool may generate, for example, a pulsed magnetic field that operates to trigger a reset of a reed switch operating as the tamper indication. Such a local manual reset assures that any tamper will involve a visit from an authorized person of record to the target.

The aforementioned remote manual reset requires an authorized person to login to a remote device that communicates with the target monitor device via a central monitoring system. Thus, for example, where the target monitor device detects some form of tampering with the device or the attachment to the target a tamper indication is set and that indication is sent to a central monitoring system. To reset this tamper indication, the authorized person must login to a device to remotely reset the tamper indication using a command issued by the central monitoring system to the target monitor device. Such a remote manual reset assures that any tamper will require an authorized person to login and thus be on record as resetting the tamper indication, but does not require physical proximity between the target and the authorized person of record.

The aforementioned auto reset allows the target monitor device to automatically reset the tamper indication after the tamper indication has been reported to the central monitoring system and is not ongoing. Thus, for example, where the target monitor device detects some form of tampering with the device or the attachment to the target a tamper indication is set and that indication is sent to a central monitoring system. The target monitor device then continues testing its tamper indication circuits and where all of the tamper indication circuits indicate that no tampering is ongoing, the tamper indication is automatically reset. As a particular example, where the target is pulling on the target monitor device such that a tamper indication is set, that tamper indication is sent to the central monitoring system and is reset once the target stops pulling on the target monitor device. Such an auto reset does not require interaction with any authorized person to occur.

Figure 1B:
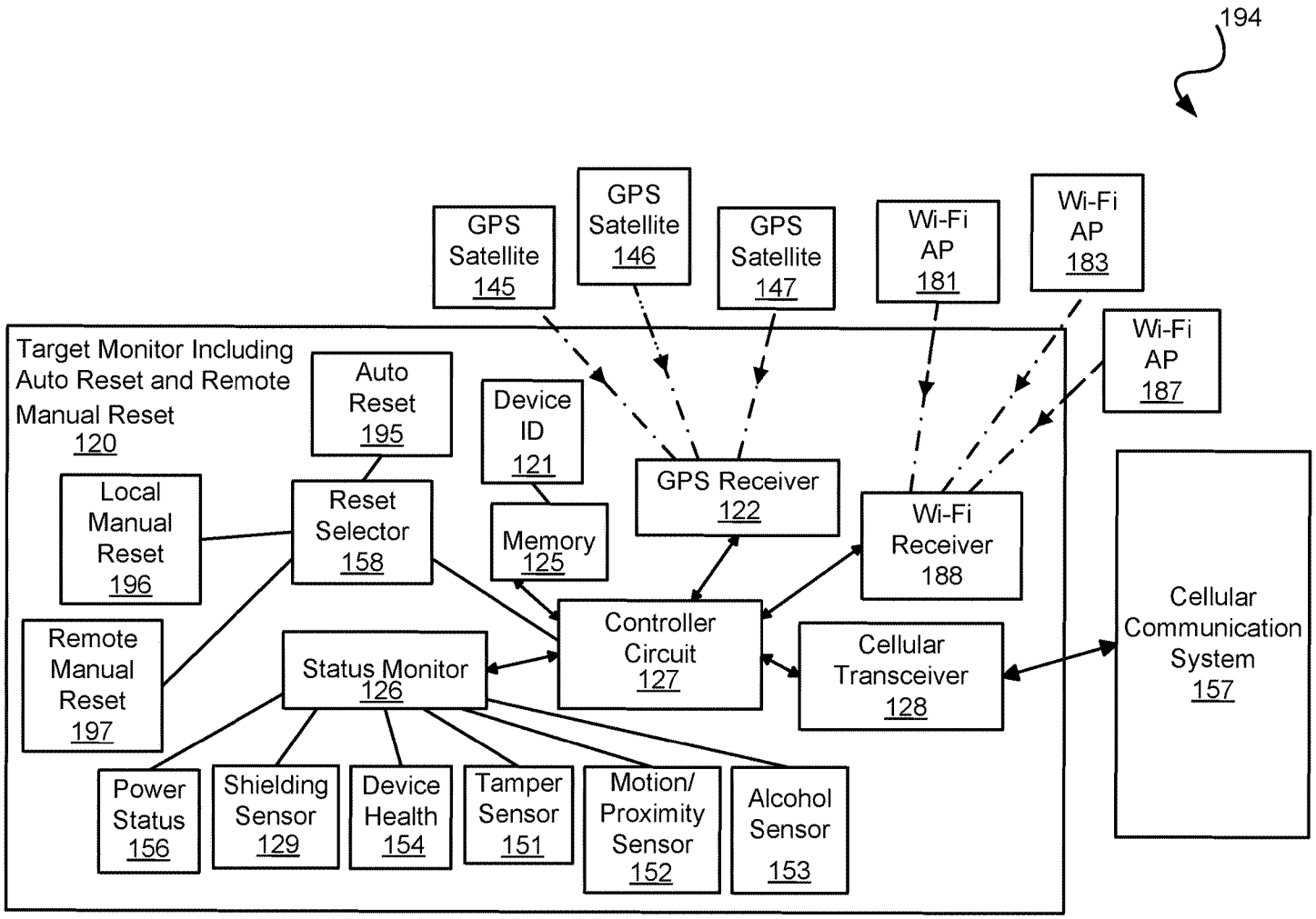
FIG. 1*b* is a block diagram of a target monitor device having both auto reset circuitry and remote manual reset circuitry in accordance with one or more embodiments of the present invention.

Turning to FIG. 1*b*, a block diagram 194 of target monitor device 120 having both auto reset circuitry 195 and remote manual reset circuitry 197 is shown in accordance with one or more embodiments of the present invention. Additionally, in this particular embodiment, target monitor device 120 includes local manual reset circuitry 196. In operation, one of auto reset circuitry 195, local manual reset circuitry 196, or remote manual reset circuitry 197 is enabled at any given time to control the reset of a tamper indication set by a controller circuit 127 based upon information sensed by one or more of a motion/proximity sensor 152, a tamper sensor 151, and a shielding sensor.

As shown, target monitor device 120 includes a device ID 121 that may be maintained in a memory 125, and thus is accessible by a controller circuit 127. Controller circuit 127 is able to interact with a GPS receiver 122 and memory 125 at times for storing and generating records of successively determined GPS locations. Similarly, controller circuit 127 is able to interact with a Wi-Fi receiver 188 and memory 125 at times for storing and generating records of successively determined Wi-Fi access point identifications and signal strength. As target monitor device 120 comes within range of one or more Wi-Fi access points (e.g., Wi-Fi access point 181, Wi-Fi access point 183 Wi-Fi access point 187), Wi-Fi receiver 188 senses the signal provided by the respective Wi-Fi access points, and provides an identification of the respective Wi-Fi access point and a signal strength of the signal received from the Wi-Fi access point to Wi-Fi receiver 188. This information is provided to controller circuit 127 which stores the information to memory 125.

Where target monitor device 120 is operating in a standard mode, controller circuit 127 causes an update and reporting of the location of target monitor device 120 via a cellular transceiver 128 and a cellular communication system 157 in accordance with a first time period. In contrast, where target monitor device 120 is within range of a public Wi-Fi access point, reporting the location of target monitor device 120 may be done via the public Wi-Fi access point in place of the cellular communication link. Which technologies are used to update the location of target monitor device 120 may be selected either by default, by programming from a central monitor system (not shown), or based upon scenarios. For example, it may be determined whether sufficient battery power as reported by power status 156 remains in target monitor device 120 to support a particular position determination technology. Where insufficient power remains, the particular technology is disabled. In some cases, a maximum cost of resolving location may be set for target monitor device 120. For example, resolving Wi-Fi location data may incur a per transaction cost to have a third party service provider resolve the location information. When a maximum number of resolution requests have been issued, the Wi-Fi position determination technology may be disabled. Further, it may be determined the likelihood that a particular position determination technology will be capable of providing meaningful location information. For example, where target monitor device 120 is moved indoors, GPS receiver 122 may be disabled to save power. Alternatively, where the tracking device is traveling at relatively high speeds, the Wi-Fi receiver 188 may be disabled. As yet another example, where cellular phone jamming is occurring, support for AFLT position determination may be disabled. As yet another example, where GPS jamming is occurring, GPS receiver 122 may be disabled. As yet another example, where target monitor device 120 is stationary, the lowest cost (from both a monetary and power standpoint) tracking may be enabled while all other technologies are disabled. Which position determination technologies are used may be based upon which zone a tracking device is located. Some zones may be rich in Wi-Fi access points and in such zones Wi-Fi technology may be used. Otherwise, another technology such as AFLT or GPS may be used.

Controller circuit 127 of target monitor device 120 at times functions in conjunction with cellular transceiver 128 to send and receive data and signals through cellular communication system 157. This link at times is useful for passing information and/or control signals between a central monitoring system (not shown) and target monitor device 120. The information transmitted may include, but is not limited to, location information, alcohol information, and information about the status of target monitor device 120. Based on the disclosure provided herein, one of ordinary skill in the art will recognize a variety of information that may be transferred via cellular communication system 157.

Various embodiments of target monitor device 120 include a variety of sensors capable of determining the status of target monitor 120, and of the individual associated therewith. For example, a status monitor 126 may include one or more of the following subcomponents: power status sensor 156 capable of indicating a power status of target monitor 120. The power status may be expressed, for example as a percentage of battery life remaining. Based upon the disclosure provided herein, one of ordinary skill in the art will recognize a variety of forms in which power status may be expressed. In addition, target monitor device 120 includes a set of shielding sensors 129 that are capable of determining whether target monitor device 120 is being shielded from receiving GPS signals and/or if GPS jamming is ongoing, a set of device health indicators 154, a tamper sensor 151 capable of determining whether unauthorized access to target monitor device 120 has occurred or whether target monitor device 120 has been removed from an associated human subject, a motion/proximity sensor 152 capable of determining whether target monitor device 120 is moving and/or whether it is within proximity of an individual associated with target monitor 120, and/or an alcohol sensor 153 such as that described herein. Based on the disclosure provided herein, one of ordinary skill in the art will recognize a variety of shielding sensors, a variety of device health transducers and indicators, a variety of tamper sensors, various different types of motion sensors, different proximity to human sensors, and various human body physical measurement sensors or transducers that may be incorporated into target monitor device 120 according to various different instances and/or embodiments of the present invention.

In operation, target monitor device 120 is initially configured to operate in one of: a local manual reset mode, a remote manual reset mode, or an auto reset mode. This configuration may be performed by an authorized person installing target monitor device 120 on a target using one or more commands issued to target monitor device 120 via a programming interface (e.g., via cellular transceiver 128). The configuration causes a reset selector circuit 158 to control which of local manual reset circuitry 196, remote manual reset circuitry 197, or auto reset circuitry controls resetting of the tamper indication.

Where a command is sent to configure target monitor device 120 in the local manual reset mode, only local manual reset circuitry 196 controls resetting of any tamper indication set by controller circuit 127. Local manual reset circuitry 196 requires the use of a specialized tool (not shown) brought into proximity of target monitor device 120 to perform a reset of a target indication. As an example, the specialized tool may generate, for example, a pulsed magnetic field that operates to trigger a reset of a reed switch operating as the tamper indication. In such a case, local manual reset circuitry 196 includes a sensor circuit capable of sensing the pulsed magnetic filed from the specialized field.

Alternatively, where a command is sent to configure target monitor device 120 in the remote manual reset mode, only remote manual reset circuitry 197 controls resetting of any tamper indication set by controller circuit 127. Remote manual reset circuitry 197 requires the reception of a command from a central monitoring system 160 via cellular transceiver 128. In operation, cellular transceiver 128 transfers the received command to controller circuit 127 that parses the command and sends it to remote manual reset circuitry 197. Where the command is correct, remote manual reset circuitry 197 causes a reset of the tamper indication.

Alternatively, where a command is sent to configure target monitor device 120 in the auto reset mode, only auto reset circuitry 195 controls resetting of any tamper indication set by controller circuit 127. Auto reset circuitry 195 automatically reset any tamper indication that is no longer continuing once the tamper indication has been transmitted to central monitoring system 160 via cellular transceiver 128.

Where target monitor device 120 is initially configured to operate in either the local manual reset mode or the local remote reset mode, target monitor device 120 continues to operate in that mode. Alternatively, where target monitor device 120 is initially configured to operate in the auto reset mode, target monitor device 120 may be switched to one of the local manual reset mode or the local remote reset mode where a tamper indication is not quickly resolved. Monitoring and resetting of the occurrence of tamper indications by target monitor device 120 may be performed using one or more of the methods discussed below in relation to FIGS. 2-4.

It should be noted that while target monitor device 120 is shown with all three of local manual reset circuit 196, remote manual reset circuit 197 and auto reset circuit 195 that in some embodiments only one of local manual reset circuit 196 or remote manual reset circuit 197 is included. One particular embodiment includes only remote manual reset circuit 197 and auto reset circuit 195, and does not include local manual reset circuit 196.

In such an embodiment including only remote manual reset circuit 197 and auto reset circuit 195, when target monitor device 120 is initially powered on, it comes up in an auto reset mode where auto reset circuit 195 is enabled to control resetting of any tamper indication. The state of all tamper status circuits are continuously monitored in the auto reset mode. This may include, for example, monitoring the status of a proximity tamper (e.g., motion/proximity sensor 152) that indicates that the limb is not close to the sensor indicating some possibility that the device has been tampered with, a break in continuity (e.g., tamper sensor 151) in the continuity sensor going through a strap, or an indication of shielding (e.g., shielding sensor 129) any of which may indicate some possibility that target monitor device 120 has been tampered with.

Where any of the tamper indicators indicate the possibility of a tamper status monitor circuit 126 sets a tamper indicator. The tamper indicator is transmitted to central monitoring system 160 via cellular communication system 157 along with an indication of which of the various circuits sensed the potential tamper occurrence and a time stamp. In response, central monitoring system 160 returns a command to target monitor device 120 via cellular communication system 157 to update the reset configuration. This command is processed by controller circuit 127.

It is determined whether the updated configuration received from central monitoring system 160 is a command to maintain target monitor device 120 in the auto reset mode where auto reset circuit 195 is enabled to control resetting of any tamper indication. Where a command to maintain the target monitor device in the auto reset mode is received from central monitoring system 160 by target monitor device 120, the tamper indicator remains set until unset if target monitor device 120 determines that the cause of the tamper indicator is corrected.

Alternatively, where the auto reset configuration is not being maintained (i.e., the command is to switch to the remote manual reset mode where remote manual reset circuit 197 is enabled to control resetting of any tamper indication), target monitor device 120 sets a remote manual reset mode. Then, it is determined whether a remote manual reset has been received. A remote manual reset is received in the form of a message from central monitoring system 160 initiated by an authorized person to reset any tamper indication. Where a remote manual reset is received, the tamper indication is reset. In some cases auto reset circuit 195, local manual reset circuit 196 and/or remote manual reset circuit 197 may be implemented as part of a processing circuit that executes instructions to perform the functions discussed above in relation to the respective circuits. In particular cases, auto reset circuit 195, local manual reset circuit 196 remote manual reset circuit 197, and/or controller circuit 127 are implemented as part of the same processing circuit. Based upon the disclosure provided herein, one of ordinary skill in the art will recognize a variety of configurations that may be used to implement target monitor device 120 in accordance with different embodiments.

Figure 2:
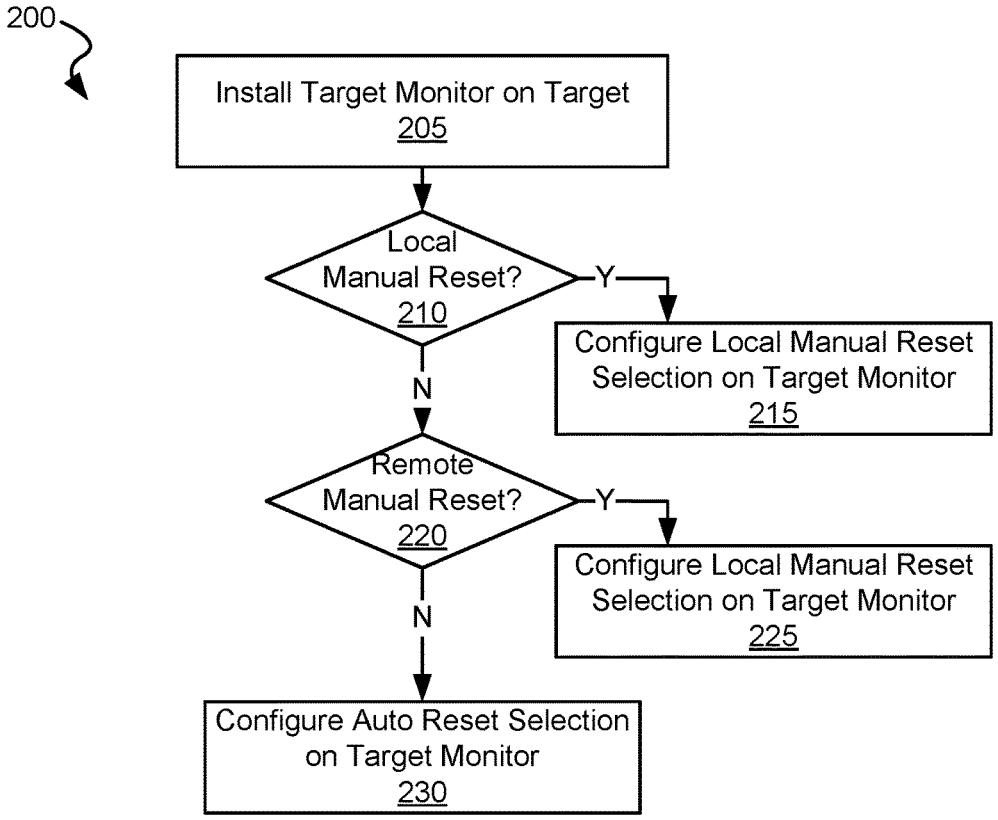
FIG. 2 is a flow diagram showing a method for initial configuration of a monitoring device in accordance with various embodiments of the present invention.

Turning to FIG. 2, a flow diagram 200 shows a method for initial configuration of a monitoring device in accordance with various embodiments of the present invention. Following flow diagram 200, a target monitor device is installed on a target (block 205). The installation may include attaching a target monitor device around a limb of a human being to be monitored, turning the target monitor device on, and assuring proper operation of the target monitor device. Based upon the disclosure provided herein, one of ordinary skill in the art will recognize a variety of processes that may be performed in relation to installing the target monitor device on a target.

It is determined whether a local manual reset is desired (block 210). A local manual reset requires an authorized person to use a specialized tool to reset any tamper indication that occurs on the target monitor device. Thus, for example, where the target monitor device detects some form of tampering with the device or the attachment to the target a tamper indication is set. To reset this tamper indication, the authorized person must visit the target and reset the tamper indication using a specialized tool. The specialized tool may generate, for example, a pulsed magnetic field that operates to trigger a reset of a reed switch operating as the tamper indication. Such a local manual reset assures that any tamper will involve a visit from an authorized person of record to the target. Where a local manual reset is desired (block 210), the target monitor device is configured to only allow resetting of a tamper indication using the specialized tool (block 215).

Alternatively, where a local manual reset is not desired (block 210), it is determined whether a remote manual reset is desired (block 220). A remote manual reset requires an authorized person to login to a remote device that communicates with the target monitor device via a central monitoring system. Thus, for example, where the target monitor device detects some form of tampering with the device or the attachment to the target a tamper indication is set and that indication is sent to a central monitoring system. To reset this tamper indication, the authorized person must login to a device to remotely reset the tamper indication using a command issued by the central monitoring system to the target monitor device. Such a remote manual reset assures that any tamper will require an authorized person to login and thus be on record as resetting the tamper indication, but does not require physical proximity between the target and the authorized person of record. Where a remote manual reset is desired (block 220), the target monitor device is configured to only allow resetting of a tamper indication when a command to reset the tamper indication is received via the central monitoring system (block 225).

Alternatively, where a remote manual reset is not desired (block 220), an auto reset is configured (block 230). An auto reset allows the target monitor device to automatically reset the tamper indication after the tamper indication has been reported to the central monitoring system. Thus, for example, where the target monitor device detects some form of tampering with the device or the attachment to the target a tamper indication is set and that indication is sent to a central monitoring system. The target monitor device then continues testing its tamper indication circuits and where all of the tamper indication circuits indicate that no tampering is ongoing, the tamper indication is automatically reset. As a particular example, where the target is pulling on the target monitor device such that a tamper indication is set, that tamper indication is sent to the central monitoring system and is reset once the target stops pulling on the target monitor device.

Figure 3:
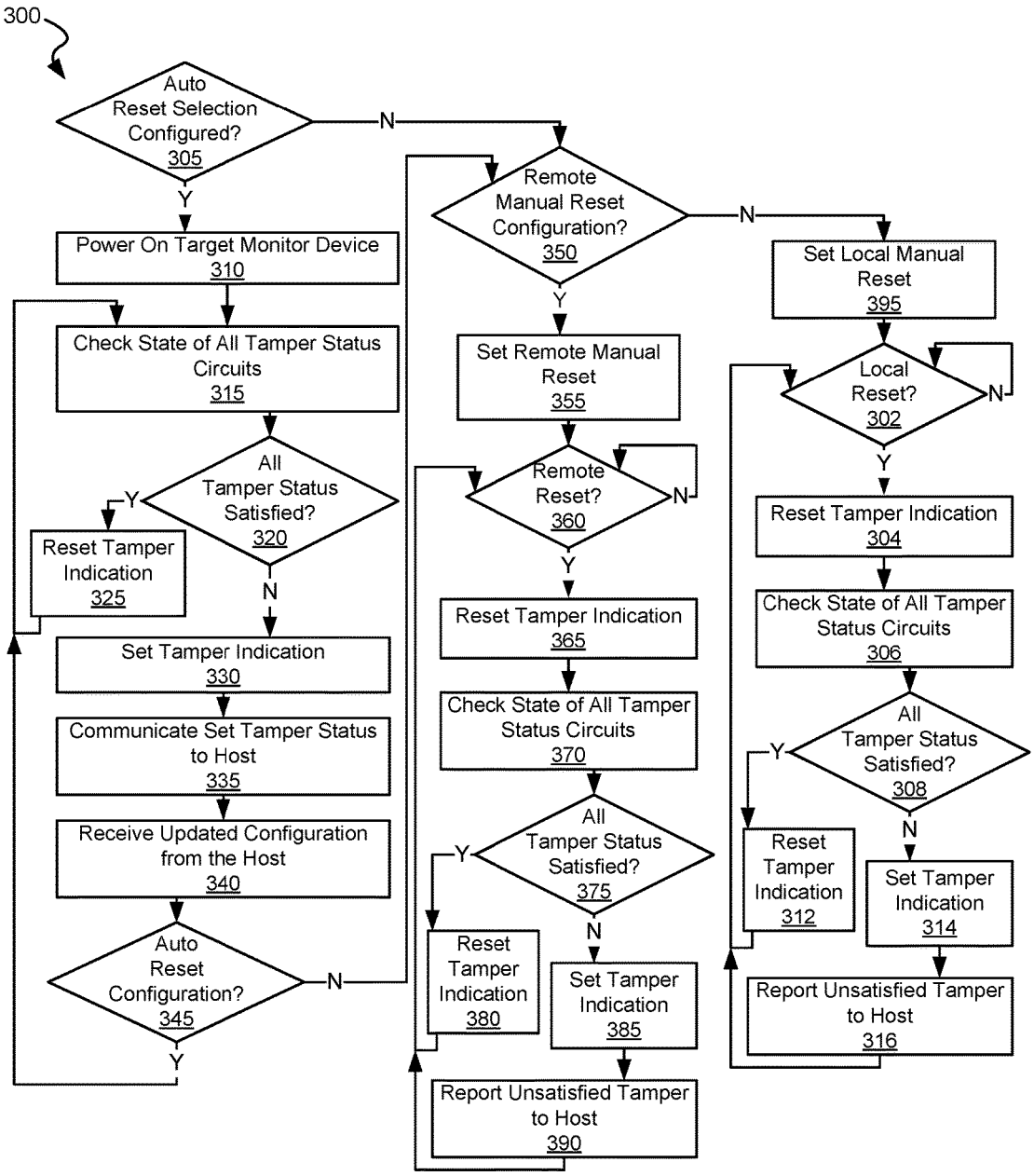
FIG. 3 is a flow diagram depicting a method for operating a hybrid auto/manual reset mode in accordance with some embodiments of the present invention.

Turning to FIG. 3, a flow diagram 300 shows a method for operating a hybrid auto/manual reset mode in accordance with some embodiments of the present invention. Following flow diagram 300, it is determined whether a target monitor device was initialized in the auto reset mode (block 305). Where the target monitor device is not configured in the auto reset mode (block 305), it is determined whether target monitor device was initialized in the remote manual reset mode (block 350). Where the target monitor device is not configured in the remote manual reset mode (block 350), local manual resetting is enabled.

Where an auto reset is configured (block 305), the target monitor device is powered on (block 310) and the state of all tamper status circuits are continuously monitored (block 315). This may include, for example, monitoring the status of a proximity tamper that indicates that the limb is not close to the sensor indicating some possibility that the device has been tampered with, or a break in continuity in the continuity sensor going through a strap indicating some possibility that the device has been tampered with. It is determined whether all tamper status is satisfied (i.e., no tamper is indicated) (block 320). Where all tamper status is satisfied (block 320), the tamper indication is reset (block 325) and the processes of blocks 315-325 are continuously repeated.

Alternatively, where one or more of the tamper circuits indicate the occurrence of a potential tamper (block 320), a tamper indication is set (block 330). A tamper status is transmitted from the target monitor device to the central monitoring system or host (block 335). The tamper status indicates which tamper status circuit (e.g., a continuity circuit, and/or a proximity circuit) that indicated the tamper and a time stamp of when the tampering event occurred. In response, the central monitoring system returns a command to the target monitor device to update the reset configuration (block 340).

It is determined whether the updated configuration received from the central monitoring system is a command to maintain the target monitor device in the auto reset mode (block 345). Where a command to maintain the target monitor device in the auto reset mode is received from the central monitoring system by the target monitor device (block 345), the processes of blocks 315 through 340 are repeated in hopes that the detected tamper occurrence was spurious or temporary and the target monitor device will be able to clear it without intervention of an authorized person.

Alternatively, where the auto reset configuration is not being maintained (block 345), target monitor device determines whether the updated reset mode is the remote manual reset mode (block 350). Where it is the remote manual reset mode that is selected (block 350), the remote manual reset mode is set (block 355). Then, it is determined whether a remote manual reset has been received (block 360). A remote manual reset is received in the form of a message from the central monitoring system initiated by an authorized person to reset any tamper indication. Where a remote manual reset is received (block 360), the tamper indication is reset (block 365).

The state of all tamper status circuits are continuously monitored (block 370). Again, this may include, for example, monitoring the status of a proximity tamper that indicates that the limb is not close to the sensor indicating some possibility that the device has been tampered with, or a break in continuity in the continuity sensor going through a strap indicating some possibility that the device has been tampered with. It is determined whether all tamper status is satisfied (i.e., no tamper is indicated) (block 375). Where all tamper status is satisfied (block 375), the tamper indication is reset (block 380) and the processes of blocks 360-375 are continuously repeated.

Alternatively, where all tamper status is not satisfied (i.e., a tamper is indicated) (block 375), a tamper indication is set (block 385). A tamper status is transmitted from the target monitor device to the central monitoring system or host (block 390). The tamper status indicates which tamper status circuit (e.g., a continuity circuit, and/or a proximity circuit) that indicated the tamper and a time stamp of when the tampering event occurred. At this juncture, the processes of blocks 360-390 are repeated for the remote manual reset mode.

As yet another alternative, where the auto reset configuration is not being maintained (block 345) and the target monitor device determines that the updated reset mode is not the remote manual reset mode (block 350), the local manual reset mode is set (block 395). Then, it is determined whether a local manual reset has been received (block 302). A local manual reset is received in the form of an authorized person using a specialized tool in physical proximity to the target monitor device. The specialized tool may generate, for example, a pulsed magnetic field that operates to trigger a reset of a reed switch operating as the tamper indication. Such a local manual reset assures that any tamper will involve a visit from an authorized person of record to the target. Where a local manual reset is received (block 302), the tamper indication is reset (block 304).

The state of all tamper status circuits are continuously monitored (block 306). Again, this may include, for example, monitoring the status of a proximity tamper that indicates that the limb is not close to the sensor indicating some possibility that the device has been tampered with, or a break in continuity in the continuity sensor going through a strap indicating some possibility that the device has been tampered with. It is determined whether all tamper status is satisfied (i.e., no tamper is indicated) (block 308). Where all tamper status is satisfied (block 308), the tamper indication is reset (block 312) and the processes of blocks 302-312 are continuously repeated.

Alternatively, where all tamper status is not satisfied (i.e., a tamper is indicated) (block 308), a tamper indication is set (block 314). A tamper status is transmitted from the target monitor device to the central monitoring system or host (block 316). The tamper status indicates which tamper status circuit (e.g., a continuity circuit, and/or a proximity circuit) that indicated the tamper and a time stamp of when the tampering event occurred. At this juncture, the processes of blocks 302-316 are repeated for the local manual reset mode.

Figure 4:
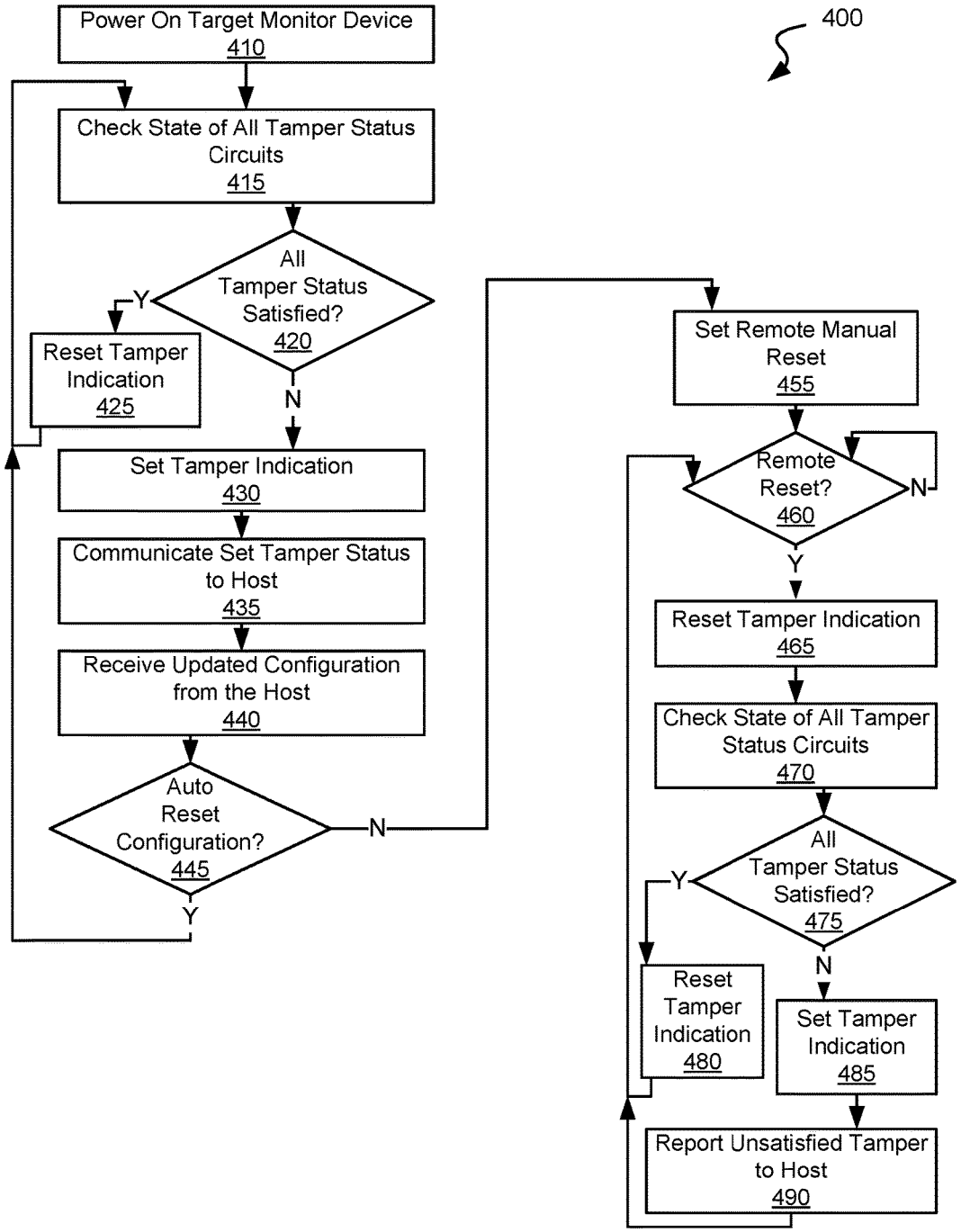
FIG. 4 is a flow diagram depicting a particular method for operating a hybrid auto/manual reset mode where a target monitor device is always initialized in an auto reset mode and only a remote manual reset mode is available in addition to the auto reset mode in accordance with various embodiments of the present invention.

Turning to FIG. 4, a flow diagram 400 depicts a particular method for operating a hybrid auto/manual reset mode where a target monitor device is always initialized in an auto reset mode and only a remote manual reset mode is available in addition to the auto reset mode in accordance with various embodiments of the present invention. Following flow diagram 400, the target monitor device is powered on (block 410) and the state of all tamper status circuits are continuously monitored (block 415). This may include, for example, monitoring the status of a proximity tamper that indicates that the limb is not close to the sensor indicating some possibility that the device has been tampered with, or a break in continuity in the continuity sensor going through a strap indicating some possibility that the device has been tampered with. It is determined whether all tamper status is satisfied (i.e., no tamper is indicated) (block 420). Where all tamper status is satisfied (block 420), the tamper indication is reset (block 425) and the processes of blocks 415-425 are continuously repeated.

Alternatively, where one or more of the tamper circuits indicate the occurrence of a potential tamper (block 420), a tamper indication is set (block 430). A tamper status is transmitted from the target monitor device to the central monitoring system or host (block 435). The tamper status indicates which tamper status circuit (e.g., a continuity circuit, and/or a proximity circuit) that indicated the tamper and a time stamp of when the tampering event occurred. In response, the central monitoring system returns a command to the target monitor device to update the reset configuration (block 440).

It is determined whether the updated configuration received from the central monitoring system is a command to maintain the target monitor device in the auto reset mode (block 445). Where a command to maintain the target monitor device in the auto reset mode is received from the central monitoring system by the target monitor device (block 445), the processes of blocks 415 through 440 are repeated in hopes that the detected tamper occurrence was spurious or temporary and the target monitor device will be able to clear it without intervention of an authorized person.

Alternatively, where the auto reset configuration is not being maintained (block 445), target monitor device sets a remote manual reset mode (block 455). Then, it is determined whether a remote manual reset has been received (block 460). A remote manual reset is received in the form of a message from the central monitoring system initiated by an authorized person to reset any tamper indication. Where a remote manual reset is received (block 460), the tamper indication is reset (block 465).

The state of all tamper status circuits are continuously monitored (block 470). Again, this may include, for example, monitoring the status of a proximity tamper that indicates that the limb is not close to the sensor indicating some possibility that the device has been tampered with, or a break in continuity in the continuity sensor going through a strap indicating some possibility that the device has been tampered with. It is determined whether all tamper status is satisfied (i.e., no tamper is indicated) (block 475). Where all tamper status is satisfied (block 475), the tamper indication is reset (block 480) and the processes of blocks 460-475 are continuously repeated.

Alternatively, where all tamper status is not satisfied (i.e., a tamper is indicated) (block 475), a tamper indication is set (block 485). A tamper status is transmitted from the target monitor device to the central monitoring system or host (block 490). The tamper status indicates which tamper status circuit (e.g., a continuity circuit, and/or a proximity circuit) that indicated the tamper and a time stamp of when the tampering event occurred. At this juncture, the processes of blocks 460-490 are repeated for the remote manual reset mode.

In conclusion, the present invention provides for novel systems, devices, and methods for monitoring individuals and/or assets. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A monitoring system, the monitoring system comprising:

a mobile monitoring device including:

a tamper detection circuit operable to set a tamper indicator when an event indicative of a tamper with the mobile monitoring device is detected;

a plurality of tamper reset circuits including at least: a first tamper reset circuit operable to reset the tamper indicator based upon a first reset condition, and a second tamper reset circuit operable to reset the tamper indicator based upon a second reset condition;

a controller circuit operable to select only one of the plurality of tamper reset circuits to govern a reset of the tamper indicator;

a central monitoring system, wherein the mobile monitoring device is operable to report the tamper indicator to the central monitoring system via a communication link, and wherein the central monitoring system is operable to send a command to the mobile monitoring device via the communication link based at least in part on the tamper indicator; and wherein the command is operable to cause the controller circuit to select the second tamper reset circuit based upon the command.

2. The monitoring system of claim 1, wherein the tamper detection circuit includes at least one of: a strap continuity detector circuit, a proximity sensor circuit, and a shielding sensor circuit.

3. The monitoring system of claim 1, wherein the tamper detection circuit includes at least two of: a strap continuity detector circuit, a proximity sensor circuit, and a shielding sensor circuit.

4. The monitoring system of claim 1, wherein the controller circuit is operable to select the first tamper reset circuit upon initialization of the mobile monitoring device.

5. The monitoring system of claim 1, wherein the first tamper reset circuit is an auto tamper reset circuit that resets the tamper indicator without intervention from an authorized person; and wherein the second tamper reset circuit is a manual tamper reset circuit that resets the tamper indicator only after intervention from the authorized person.

6. The monitoring system of claim 5, wherein the manual tamper reset circuit is a remote manual tamper reset circuit that resets the tamper indicator only after the authorized person logs in remotely and approves the reset.

7. The monitoring system of claim 5, wherein the manual tamper reset circuit is a local manual tamper reset circuit that resets the tamper indicator only after a specialized tool is used in proximity to the monitoring device.

8. The monitoring system of claim 7, wherein the specialized tool generates a magnetic field detectable by the local manual tamper reset circuit.

9. The monitoring system of claim 1, wherein the communication link is a cellular communication link.

10. A method for governing tamper detection in a monitoring system, the method comprising:

providing a monitoring device including a tamper detection circuit operable to set a tamper indicator when an event indicative of a tamper with the monitoring device is detected;

initializing a reset of the tamper indicator of the monitoring device in a first tamper reset mode;

transmitting the tamper indicator to a central monitoring system;

receiving a command from the central monitoring system at least in part based upon the tamper indicator; and based at least in part on the command, changing the reset of the tamper indicator of the monitoring device to a second tamper reset mode.

11. The method of claim 10, wherein the tamper detection circuit includes at least one of: a strap continuity detector circuit, a proximity sensor circuit, and a shielding sensor circuit.

12. The method of claim 10, wherein transmitting the tamper indicator to the central monitoring system is done using a wireless communication link.

13. The method of claim 12, wherein the wireless communication link is a cellular communication link.

14. The method of claim 10, wherein the first tamper reset mode is an auto tamper reset mode that resets the tamper indicator without intervention from an authorized person; and wherein the second tamper reset mode is a manual tamper reset mode that resets the tamper indicator only after intervention from the authorized person.

15. The method of claim 14, wherein the manual tamper reset mode is a remote manual tamper reset mode that resets the tamper indicator only after the authorized person logs in remotely and approves the reset.

16. The method of claim 14, wherein the manual tamper reset mode is a local manual tamper reset mode that resets the tamper indicator only after a specialized tool is used in proximity to the monitoring device.

17. The method of claim 16, wherein the specialized tool generates a magnetic field detectable by the local manual tamper reset circuit.

18. A monitoring system, the monitoring system comprising:

a monitoring device including:

a tamper detection circuit operable to set a tamper indicator when an event indicative of a tamper with the monitoring device is detected;

a processing circuit operable to:

initialize a reset of the tamper indicator of the monitoring device in a first tamper reset mode;

transmit the tamper indicator to a central monitoring system;

receive a command from a central monitoring system at least in part based upon the tamper indicator; and based at least in part on the command, change the reset of the tamper indicator of the monitoring device to a second tamper reset mode.

19. The system of claim 18, wherein the first tamper reset mode is an auto tamper reset mode that resets the tamper indicator without intervention from an authorized person; and wherein the second tamper reset mode is a manual tamper reset mode that resets the tamper indicator only after intervention from the authorized person.

20. A monitoring system, the monitoring system comprising:

a central monitoring system, wherein the central monitoring system is operable to:

receive a tamper indicator from a remote monitoring device via a communication link, wherein the remote monitoring device includes: at least a first tamper reset circuit configured to reset the tamper indicator based upon a first reset condition, a second tamper reset circuit configured to reset the tamper indicator based upon a second reset condition, and a controller circuit operable to select one of the first tamper reset circuit or the second tamper reset circuit to govern a reset of the tamper indicator; and send a command to the remote monitoring device via the communication link based at least in part on the tamper indicator; and wherein the command is operable to cause the controller circuit in the remote monitoring device to select the second tamper reset circuit.

21. The monitoring system of claim 20, wherein the first tamper reset circuit is an auto tamper reset circuit that resets the tamper indicator without intervention from an authorized person; and wherein the second tamper reset circuit is a manual tamper reset circuit that resets the tamper indicator only after intervention from the authorized person.

22. The monitoring system of claim 21, wherein the manual tamper reset circuit is a remote manual tamper reset circuit that resets the tamper indicator only after the authorized person logs in remotely and approves the reset.

23. The monitoring system of claim 21, wherein the manual tamper reset circuit is a local manual tamper reset circuit that resets the tamper indicator only after a specialized tool is used in proximity to the monitoring device.

24. The monitoring system of claim 20, wherein the monitoring system further includes the remote monitoring device.

* * * * *